US007593007B2

(12) United States Patent
Wu et al.

(10) Patent No.: US 7,593,007 B2
(45) Date of Patent: Sep. 22, 2009

(54) COLOR-SEQUENTIAL DISPLAY METHOD

(75) Inventors: Biing-Seng Wu, Hsinhua (TW); Lin-Kai Bu, Hsinhua (TW); Chien-Pin Chen, Hsinhua (TW)

(73) Assignee: Himax Technologies Limited, Tainan County (TW)

( * ) Notice: Subject to any disclaimer, the term of this patent is extended or adjusted under 35 U.S.C. 154(b) by 628 days.

(21) Appl. No.: 11/193,399

(22) Filed: Aug. 1, 2005

(65) Prior Publication Data

US 2006/0028424 A1 Feb. 9, 2006

(30) Foreign Application Priority Data

Aug. 3, 2004 (TW) ..... 93123280 A

(51) Int. Cl.
*G09G 5/00* (2006.01)

(52) U.S. Cl. ..... 345/204; 345/100; 345/691

(58) Field of Classification Search ..... 345/204, 345/100, 691
See application file for complete search history.

(56) References Cited

U.S. PATENT DOCUMENTS 6,507,350 B1 1/2003 Wilson
7,151,512 B2 * 12/2006 Johnson et al. ..... 345/76

FOREIGN PATENT DOCUMENTS

| | | |
|---|---|---|
| JP | 08-248381 | 9/1996 |
| JP | 2003-162261 | 6/2003 |
| JP | 2003-195820 | 7/2003 |
| JP | 2003-280614 | 10/2003 |
| JP | 2003-284088 | 10/2003 |
| JP | 2003-287733 | 10/2003 |
| WO | WO-01/69584 | 9/2001 |

* cited by examiner

*Primary Examiner*—Richard Hjerpe
*Assistant Examiner*—Leonid Shapiro
(74) *Attorney, Agent, or Firm*—Rabin & Berdo, P.C.

(57) ABSTRACT

A display method for driving a color-sequential display of an electronic device is provided. When the electronic device is not at low power mode, a first image is displayed first by using a second color data and a first color data of the first image sequentially to drive the display. Next, a second image is displayed by using a second color data and a third color data of the second image sequentially to drive the display. When the electronic device is at low power mode, the respective luminance of the first and the second images are obtained. Then, the respective luminance of the first image and the second image are sequentially used to drive the display.

14 Claims, 6 Drawing Sheets

COLOR-SEQUENTIAL DISPLAY METHOD

This application claims the benefit of Taiwan application Ser. No. 93123280, filed Aug. 3, 2004, the subject matter of which is incorporated herein by reference.

BACKGROUND OF THE INVENTION

1. Field of the Invention

The invention relates in general to a display method, and more particularly to a color-sequential display method.

2. Description of the Related Art

With the rapid advance in display technology in recent years, the liquid crystal display (LCD), having the features of slimness, light weight, and low radiation, has gradually become the mainstream display product.

The liquid crystal panel, which includes a number of pixels arranged in a matrix, controls the luminance of the pixel for entire LCD panel to display frames through the input of image data of respective pixels. Since the pixel can only display the grey level from brightness to darkness, other means are needed for the display of colors.

A conventional LCD displays the color through a color filter which displays the three primary color components of a pixel at the same time. Each pixel of the above color filter LCD includes three displaying units respectively corresponding to a red, a green and a blue filters. The red light, green light and blue light displayed via the filter are combined and the colors of the pixel are perceived by the viewer.

Another conventional color-sequential LCD displays color by sequentially displaying the components of the three primary color of a pixel. Each pixel of the above color-sequential LCD includes a displaying unit, which respectively emits red light, green light and blue light respectively from three luminous sources as the backlight source. During a frame time, the pixel sequentially displays three data and red light, green light and blue light sources are correspondingly turned on. Through the persistence of vision, a viewer is able to recognize the color of a pixel.

Compared with the color filter LCD, the color-sequential LCD displays color is without using a color filter, therefore is advantageous in cost saving. Besides, the color-sequential display method, which only requires one pixel to determine the color of a pixel, increases the resolution by three times when used to display the color of an LCD.

However, the color-sequential needs to input image data to a pixel in three times in order to completely input the image data to the pixel, thereby requiring pulses with higher frequency and consequently consuming more power.

On the other hand, an ordinary electronic device would reduce the frame rate of the display to achieve energy saving when at a low power mode. For example, when the frame rate is reduced to 20 Hz from 60 Hz, i.e., from displaying 60 frame data per second to displaying 20 frame data per second. However, due to the decrease in frame rate, the image data displayed according to the conventional color-sequential display method would not be perceived by the viewer as color through the persistence of vision. What the viewer would perceive is the flickering of red, green or blue colors.

It can be seen from the above description that using the color-sequential method to display the LCD color has the advantage of an increased resolution but has its shortcomings at the same time. Therefore, how to reduce the power required for the transmission of image data and enable the color-sequential display method to support a low power mode has become an important issue to be resolved.

SUMMARY OF THE INVENTION

According to the object of the invention a color-sequential display method with the advantage of reducing power consumption of image display and having low power mode support is provided.

It is therefore an object of the invention to provide a display method for driving the color-sequential display of the electronic device. When the electronic device is not at low power mode, a first image is displayed first, wherein the first image sequentially uses a second color data and a first color data of the first image to drive the display. Next, a second image is displayed; wherein the second image sequentially uses a second color data and a third color data of the second image to drive the display. When the electronic device is at low power mode, the respective luminance of the first and the second images are obtained. Lastly, the respective luminance of the first image and the second image are sequentially used to drive the display.

Other objects, features, and advantages of the invention will become apparent from the following detailed description of the preferred but non-limiting embodiments. The following description is made with reference to the accompanying drawings.

DETAILED DESCRIPTION OF THE INVENTION

FIRST EMBODIMENT

Figure 1:
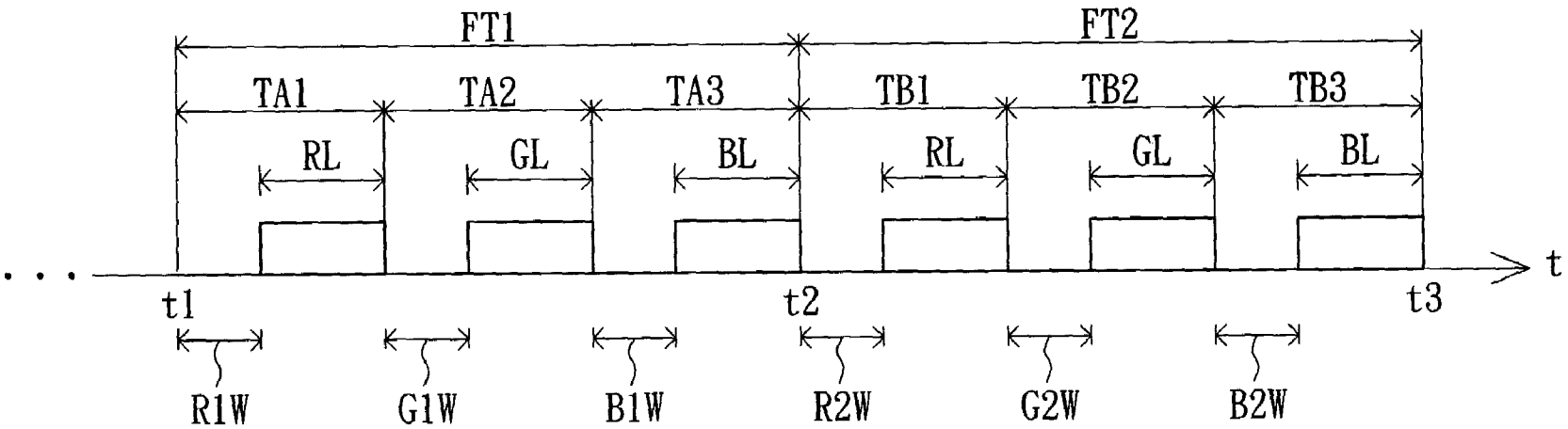
FIG. 1(PRIOR ART)
FIG. 1 is a diagram showing the display process of conventional color-sequential display.

Referring to FIG. 1, a diagram showing the display process of conventional color-sequential display is shown. Take a first image and a second image for example. The first image and the second image respectively include a red data R, a green data G and a blue data B, wherein the first image is displayed at a first frame time FT1, and the second image is displayed at a second frame time FT2. The display has a red, a green and a blue backlight sources. Conventional color-sequential display method has the first frame time FT1 from time t1 to time t2 divided to time domains TA1, TA2 and TA3, and sequentially and respectively displays a red data R1, a green data G1 and a blue data B1 of the first image during the three time domain. So a viewer can recognize the color image of the first frame time FT1 through the persistence of vision.

To put it more precisely, the red data R1 of the first image is written to all pixels of the display first during a write period R1W of the time domain TA1. Next, the red backlight source is turned on during a turn-on period RL of the time domain TA1 for the red data R1 to be displayed on the display. Similarly, the green data G1 of the first image is written to all pixels of the display during a write period G1W of the time domain TA2. Then, the green backlight source is turned on for the green data G1 to be displayed on the display during a turn-on period GL of the time domain TA2. The blue data B1 of the first image is written to all pixels of the display during write period B1W of the time domain TA3. Then, the blue backlight source is turned on for the blue data B1 to be displayed on the display during a turn-on period BL of the time domain TA3.

The second frame time FT2 from time t2 to time t3 is also divided to three time domains, which are time domains TB1, TB2 and TB3 respectively. The method for displaying the second image during the second frame time FT2, which is basically the same with the method for displaying the first image during the first frame time FT1, sequentially and respectively displays a red data R2, a green data G2 and a blue data B2 of the second image during time domains TB1, TB2 and TB3.

Figure 2A:
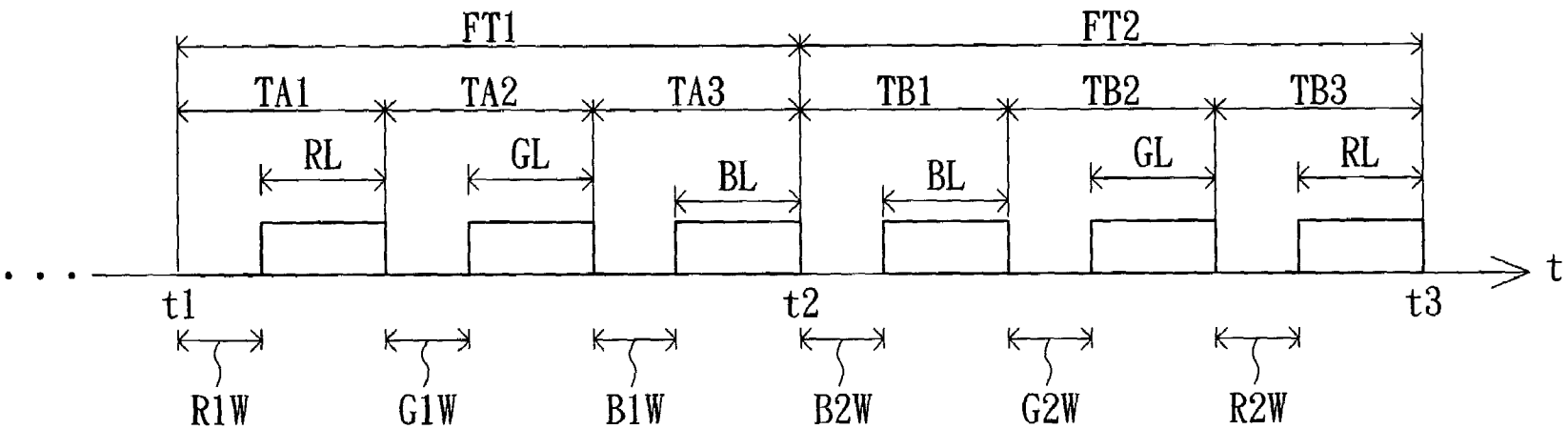
FIG. 2A is a diagram showing the display process of a color-sequential display according to a first embodiment of the invention.

Referring to FIG. 2A, a diagram showing the display process of a color-sequential display according to a first embodiment of the invention is shown. Like the conventional color-sequential display method, the color-sequential display method of the present embodiment also divides the first frame time and the second frame time respectively to three time domains. However, unlike the conventional color-sequential display method which displays the first image and the second image according to the sequence of red data R, green data G and blue data B, the color-sequential display method of the present embodiment does not display the first image and the second image according to a fixed order of red data R, green data G and blue data B.

In the display method according to the first embodiment, the first frame time FT1 is divided to three time domains TA1, TA2 and TA3, and the red data R1, the green data G1 and the blue data B1 of the first image is sequentially and respectively displayed during the three time domains. Although the second frame time FT2 is also divided to three time domains, namely time domains TB1, TB2 and TB3 respectively, the blue data B2, the green data G2 and the red data R2 of the second image are sequentially and respectively displayed during the three time domains of the second frame time FT2.

Figure 2B:
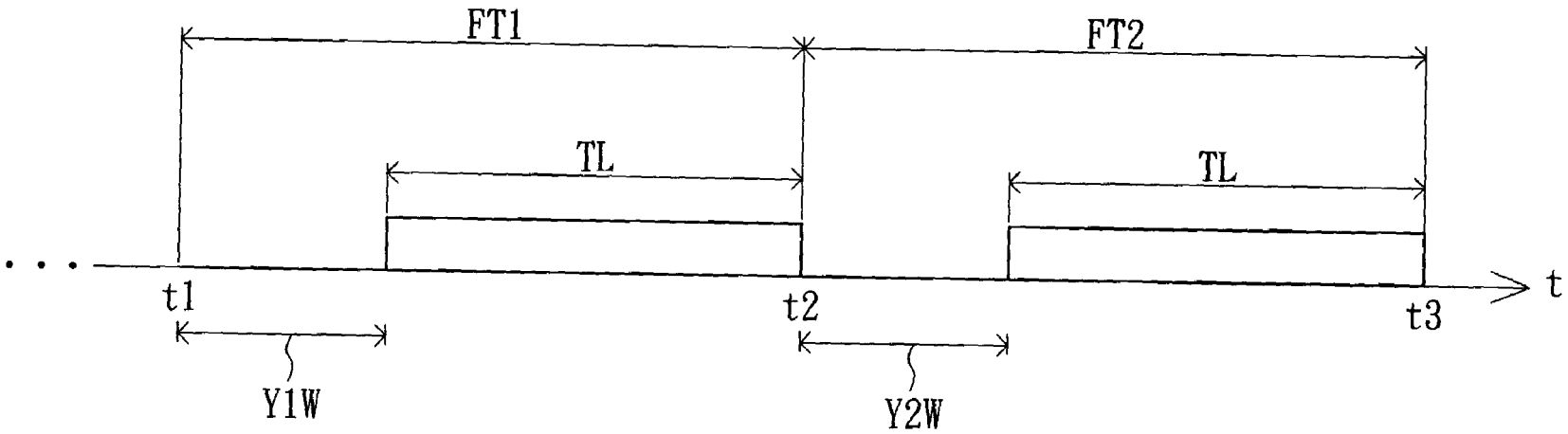
FIG. 2B is a diagram showing the display process of another color-sequential display according to a first embodiment of the invention.

Referring to FIG. 2B, a diagram showing the display process of another color-sequential display according to a first embodiment of the invention is shown. When the electronic device is at low power mode, the display method of FIG. 2B instead of FIG. 2A is used to drive the color-sequential display of the electronic device. The display method of FIG. 2B obtains the luminance of the to-be-displayed image first and uses the luminance of the image to drive the display accordingly.

That is, when the electronic device is at low power mode and would like to display the first image during the first frame time FT1, the first image in an RGB domain for instance is converted to an YUV image data and written to all pixels of the display during a write period Y1W of the first frame time FT1 using an Y component of the YUV image data as the luminance, then a backlight source is turned on during a turn-on period TL of the first frame time FT1 for the first luminance of the image to be displayed on the display. In the method of converting the image data from the RGB domain to the YUV domain, the mode of turning on a backlight source during the turn-on period TL of the first frame time FT1 can use different turn-on modes to turn on backlight source according to the required level of energy saving. For example, turn on the red backlight source, the green backlight source and the blue backlight source at the same time; turn on the three backlight sources with low luminance; turn on at least one of the three backlight sources; or not turn on the backlight source. By doing so, the display method of the first embodiment is able to support the low power mode.

SECOND EMBODIMENT

Figure 3A:
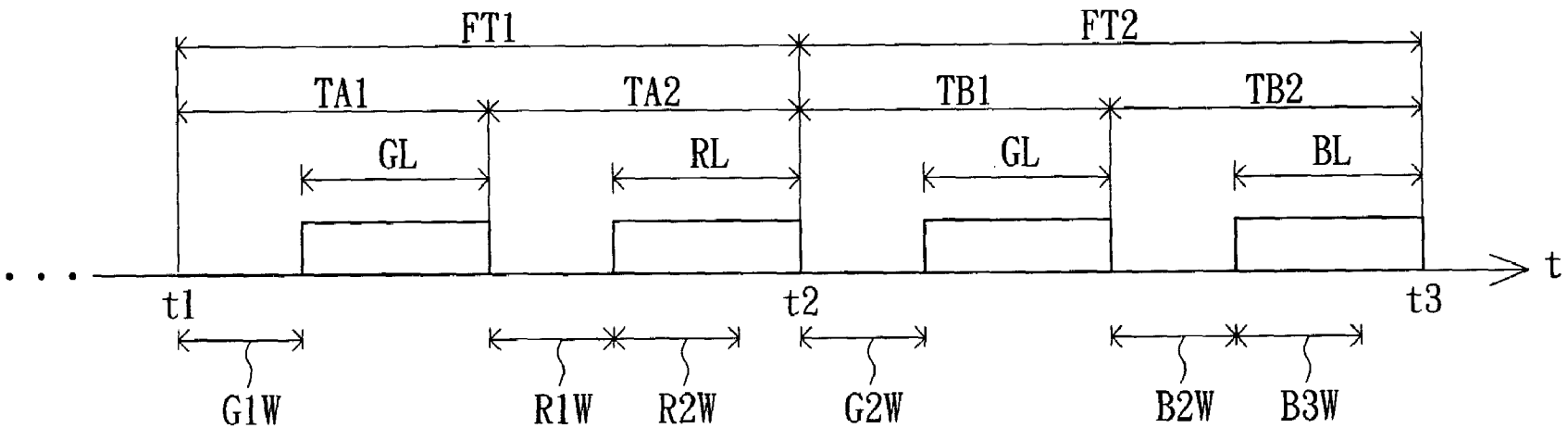
FIG. 3A is a diagram showing the display process of a color-sequential display according to a second embodiment of the invention.

Referring to FIG. 3A, a diagram showing the display process of a color-sequential display according to a second embodiment of the invention is shown. Compared with the conventional color-sequential display method, the color-sequential display method of the second embodiment respectively divides the first frame time FT1 and the second frame time FT2 to two time domains. The first frame time FT1, which is divided to time domains TA1 and TA2, sequentially and respectively displays the green data G1 and the red data R1 of the first image during the two time domains. The second frame time FT2, which is divided to time domains TB1 and TB2, sequentially and respectively displays the green data G2 and the blue data B2 of the second image during the two time domain.

That is, the green data G1 of the first image is written to all pixels of the display first during the write period G1W of the time domain TA1, and then the green backlight source is turned on for the green data G1 to be displayed on the display during the turn-on period GL of the time domain TA1. The red data R1 of the first image is written to all pixels of the display during the write period R1W of the time domain TA2, and then the red backlight source is turned on for the red data R1 to be displayed on the display during the turn-on period RL of the time domain TA2. The green data G2 of the second image is written to all pixels of the display during the write period G2W of the time domain TB1, and then the green backlight source is turned on for the green data G2 to be displayed on the display during the turn-on period GL of time domain TB1. The blue data B2 of the second image is written to all pixels of the display during the write period B2W of the time domain TB2, and then the blue backlight source is turned on for the blue data B2 to be displayed on the display during the turn-on period BL of the time domain TB2.

Of the three color data during a frame time, only two color data are displayed in the display method of the second embodiment, thereby reducing the power for transmitting image. For example, refer to FIG. 2A, in the first embodiment, the display sequentially displays two color data, i.e., the blue data B1 of the first image and the blue data B2 of the second image. The two color data are at adjacent frames, and thus have little differences. Since both of the two color data use the blue backlight source as the backlight, the second data of the two sequential color data can be left out in the second embodiment without deteriorating image quality. Furthermore, the power consumption can be effectively reduced. As shown in FIG. 3A, only the red data R1 of the first image is written to all pixels of the display with the red data R2 of the second image being left out during the write period R1W of the time domain TA2; then, the red backlight source is turned on for the red data R1 to be displayed on the display during the turn-on period RL of the time domain TA2.

Figure 4:
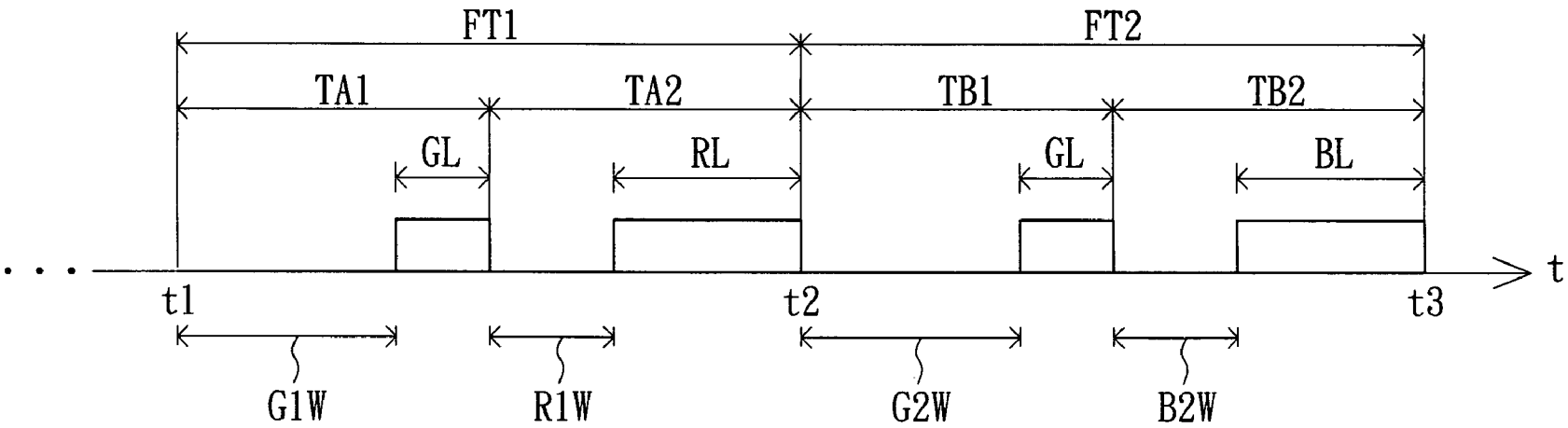
FIG. 4 is a diagram showing the display process of another color-sequential display according to a second embodiment of the invention.

According to the display method of the second embodiment, the green backlight source is turned on twice as much as the red backlight source and the blue backlight source. In order to keep the display content intact, the backlight sources of three colors of the display are preferably be adjusted accordingly. For example, the luminance of the green backlight source is adjusted to be a half of the red backlight source and blue backlight source. That is, the ratio among the luminance of the red backlight source, the luminance of the green backlight source and the luminance of the blue backlight source is adjusted as 2:1:2, or as shown in FIG. 4, the turn-on period GL of the time domains TA1 and TB1 can be adjusted to be a half of the turn-on period RL of the time domain TA2 and the turn-on period BL of the time domain TB2. That is, the ratio among the turn-on time of the red backlight source, the turn-on time of the green backlight source and the turn-on time of the blue backlight source is adjusted to be 2:1:2.

It can be seen from the above disclosure that the color-sequential display method of the second embodiment only display two color data no matter during the first frame time FT1 or the second frame time FT2, not only effectively reducing the number of color data to be transmitted, but also reducing the power for transmitting the image.

Refer to FIG. 3A, the display method of the second embodiment can keep and have the red data R2 of the second image written to the write period R2W after the red data R1 is written to the write period R1W for the turn-on period RL of the time domain TA2 to display the red data R1 and the red data R2. Consequently, the color data of the second image is more complete. It is noteworthy that write period R2W to which the red data R2 is written does not necessarily to be immediate next to the write period R1W; a time interval is allowed. Besides, the write period R2W does not need to begin at turn-on period RL; an earlier start is allowed.

THIRD EMBODIMENT

Figure 3B:
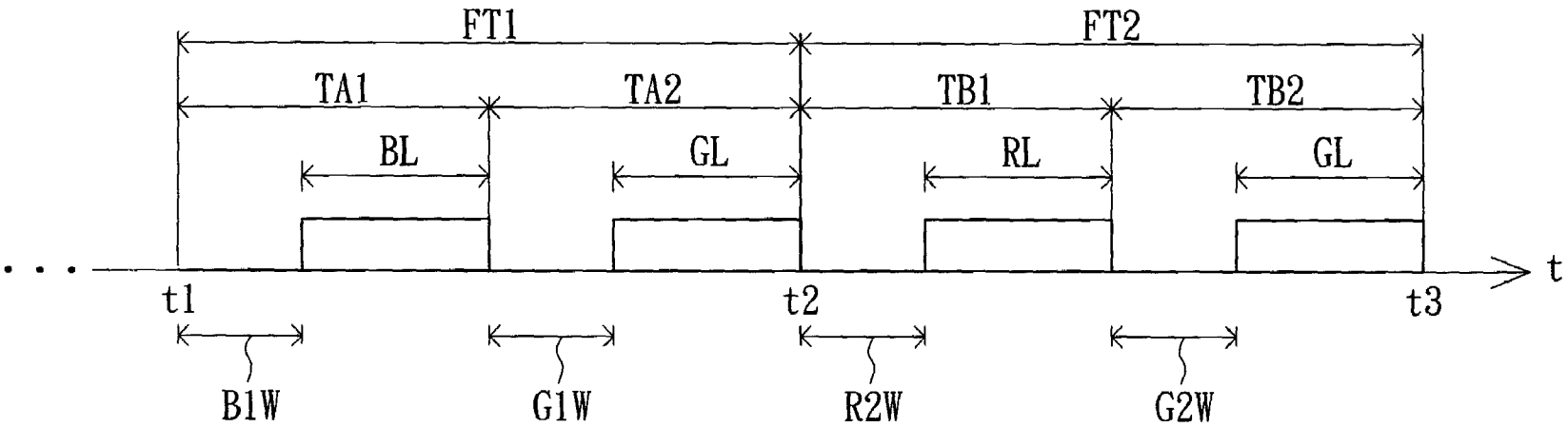
FIG. 3B is a diagram showing the display process of a color-sequential display according to a third embodiment of the invention.

Referring to FIG. 3B, a diagram showing the display process of a color-sequential display according to a third embodiment of the invention is shown. FIG. 3B is a variation of the second embodiment, and the same elements with the second embodiment are not repeated here. As shown in FIG. 3B, during a write period R2W of the time domain TB1, only the red data R2 of the second image is written to all pixels of the display with the red data R1 of the first image being left out. Then, during the turn-on period RL of the time domain TB1, the red backlight source is turned on for the red data R2 to be displayed on the display. In short, the second embodiment omits the red data R2, while third embodiment omits the red data R1 instead from the original sequential display of data B1, G1, R1, R2, G2, B2.

On the other hand, in second embodiment or third embodiment, when the electronic device is at low power mode, none of the display method of FIG. 3A, FIG. 3B or FIG. 4 is used to drive the color-sequential display of the electronic device. The to-be-displayed luminance of the image is obtained first, and then the luminance of the image is used to drive display. When the electronic device is at low power mode, the color-sequential display method of the second embodiment or third embodiment is similar to FIG. 2B, and is not repeated here. It can be seen form the above disclosures that the display method of the second embodiment or the third embodiment also supports the low power mode.

The display method disclosed in the above embodiments of the invention has the advantage of reducing power consumption of image display and having low power mode support.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A display method for driving a color-sequential display, the display using a first light source, a second light source and a third light source as a backlight, wherein the display method comprises:

displaying a first image by only using a second color data and a first color data of the first image to drive the display, the display period driven by the first color data of the first image being divided to a first write period and a first turn-on period;

displaying a second image by only using a second color data and a third color data of the second image to drive the display, the display period driven by the second color data of the second image being divided to a second write period and a second turn-on period;

writing the first color data of the first image to the display during the first write period;

turning on the first light source during the first turn-on period;

writing the second color data of the second image to the display during the second write period; and turning on the second light source during the second turn-on period.

2. The display method according to claim 1, wherein the luminance of the second light source is smaller than the first light source.

3. The display method according to claim 2, wherein the luminance of the second light source is substantially equal to a half of the luminance of the first light source.

4. The display method according to claim 1, wherein the turn-on time of the second light source is smaller than the turn-on time of the first light source.

5. The display method according to claim 4, wherein the turn-on time of the second light source is substantially equal to a half of the turn-on time of the first light source.

6. A display method for driving a color-sequential display of an electronic device, the display using a first light source, a second light source and a third light source as a backlight, the display method comprising:

determining whether the electronic device is at low power mode; and if the electronic device is not at low power mode, performing the following steps of:

displaying a first image by only using a second color data and a first color data of the first image to drive the display, the display period driven by the first color data of the first image being divided to a first write period and a first turn-on period;

displaying a second image by only using a second color data and a third color data of the second image to drive the display, the display period driven by the second color data of the second image being divided to a second write period and a second turn-on period;

writing the first color data of the first image to the display during the first write period;

turning on the first light source during the first turn-on period;

writing the second color data of the second image to the display during the second write period; and turning on the second light source during the second turn-on period.

7. The display method according to claim 6, wherein the luminance of the second light source is substantially equal to a half of the luminance of the first light source, or the turn-on time of the second light source is substantially equal to a half of the turn-on time of the first light source.

8. The display method according to claim 6, wherein if the electronic device is at low power mode, performs the following steps of:

respectively obtaining a luminance of the first image and the second image; and using the respective luminance of the first and the second images to sequentially drive the display.

9. The display method according to claim 8, wherein the first image and the second image are in RGB domain.

10. The display method according to claim 9, wherein the obtaining step comprises:

respectively converting the first image and the second image to an YUV image; and respectively using the Y component of the YUV image of the first image and the Y component of the YUV image of the second image as the luminance.

11. The display method according to claim 8, wherein the pixel uses a first light source, a second light source and a third light source as the backlight.

12. The display method according to claim 11, further comprising turning on the first light source, the second light source and the third light source at the same time.

13. The display method according to claim 11, further comprising turning on the first light source, the second light source and the third light source with low luminance simultaneously.

14. The display method according to claim 11, further comprising turning on at least one of the first light source, the second light source and the third light source.

* * * * *

UNITED STATES PATENT AND TRADEMARK OFFICE

CERTIFICATE OF CORRECTION

PATENT NO. : 7,593,007 B2
APPLICATION NO. : 11/193399
DATED : September 22, 2009
INVENTOR(S) : Wu et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1045 days.

Signed and Sealed this

Twenty-first Day of September, 2010

David J. Kappos

David J. Kappos
*Director of the United States Patent and Trademark Office*